US007339313B2

(12) United States Patent
Yoon

(10) Patent No.: US 7,339,313 B2
(45) Date of Patent: Mar. 4, 2008

(54) FLAT FLUORESCENT LAMP FOR DISPLAY DEVICES

(75) Inventor: Jae Doo Yoon, Gyunggi-Do (KR)

(73) Assignee: Mirae Corporation, Chungcheongnam-Do (KR)

( * ) Notice: Subject to any disclaimer, the term of this patent is extended or adjusted under 35 U.S.C. 154(b) by 0 days.

(21) Appl. No.: 11/035,949

(22) Filed: Jan. 18, 2005

(65) Prior Publication Data

US 2006/0043869 A1 Mar. 2, 2006

(30) Foreign Application Priority Data

Aug. 31, 2004 (KR) ..... 10-2004-0069105
Aug. 31, 2004 (KR) ..... 10-2004-0069275

(51) Int. Cl.
*H01J 63/04* (2006.01)
*H01J 11/00* (2006.01)

(52) U.S. Cl. ..... 313/491; 313/494; 313/607

(58) Field of Classification Search ..... 313/491, 313/492, 493, 494, 607, 609, 610, 594, 484, 313/485, 612, 631
See application file for complete search history.

(56) References Cited

U.S. PATENT DOCUMENTS

2002/0021564 A1* 2/2002 Cho et al. ..... 362/97
2002/0131554 A1* 9/2002 Fleming et al. ..... 378/119
2005/0007019 A1* 1/2005 Kim et al. ..... 313/607
2005/0073258 A1* 4/2005 Jang et al. ..... 313/634
2005/0110414 A1* 5/2005 Cho et al. ..... 313/634
2005/0116607 A1* 6/2005 Park et al. ..... 313/485

* cited by examiner

*Primary Examiner*—Nimeshkumar D. Patel
*Assistant Examiner*—Anne M Hines
(74) *Attorney, Agent, or Firm*—Ked & Associates, LLP

(57) ABSTRACT

A flat fluorescent lamp (FFL) for display devices, which has an improved electrode structure for plasma discharge, thus being efficiently operated using a low voltage and having high optical efficiency, is disclosed. The FFL of the present invention is provided with a plurality of branch electrodes extending from main electrodes, provided on opposite ends of a lamp body, in opposite directions toward the opposite main electrodes and being parallel to longitudinal axes of the discharge channels. Furthermore, the FFL may include joint electrodes which electrically couple the branch electrodes, provided around each of the opposite ends of the lamp body, to each other. The FFL may further include step electrodes and/or inductive electrodes.

11 Claims, 13 Drawing Sheets

FLAT FLUORESCENT LAMP FOR DISPLAY DEVICES

BACKGROUND OF THE INVENTION

1. Field of the Invention

The present invention relates, in general, to flat fluorescent lamps used as backlight units in display devices and, more particularly, to a flat fluorescent lamp for display devices, which has an improved electrode structure for plasma discharge, thus being efficiently operated using a low voltage and having high optical efficiency.

2. Description of the Related Art

Generally, display devices have been classified into two types: emissive display devices and non-emissive display devices, according to their ability to emit light. Liquid crystal displays (LCD) widely used as flat panel display devices in recent years are examples of non-emissive display devices that cannot emit light themselves, so that the LCDs must be backed with backlight units (BLU).

In recent years, flat fluorescent lamps (FFL) have been preferably and widely used as the BLUs for LCDs. The FFLs may be configured as internal electrode fluorescent lamps (IEFL) having internal electrodes for plasma discharge as shown in FIG. 1, or external electrode fluorescent lamps (EEFL) having external electrodes for plasma discharge as shown in FIG. 2.

As illustrated in FIGS. 1 and 2, a conventional FFL comprises a lamp body 100*a*, 100*b* fabricated with an upper plate 101*a*, 101*b* and a lower plate 102*a*, 102*b* which are closely integrated along their edges into a single sealed body. Furthermore, a channel 103*a*, 103*b* is formed on the lamp body 100*a*, 100*b* as a continuous long channel having a serpentine shape so that, when the upper plate 101*a*, 101*b* is integrated with the lower plate 102*a*, 102*b* into a lamp body 100*a*, 100*b*, the serpentine channel 103*a*, 103*b* defines a plasma discharge space in the FFL. The FFL further comprises electrodes 104*a*, 104*b* for plasma discharge provided at opposite ends of the serpentine channel 103*a*, 103*b*. Inert gas including mercury vapor is contained in the serpentine channel 103*a*, 103*b* to cause plasma discharge in the plasma discharge space of the FFL. Furthermore, a fluorescent material is coated onto the inner surface of the serpentine channel 103*a*, 103*b*, thus forming a fluorescent layer to emit light due to the energy of the excited gas in the channel 103*a*, 103*b*.

The electrodes of the conventional FFLs may be provided at opposite ends of the serpentine channel 103*a* by inserting the electrodes 104*a* into the ends, thus providing an IEFL as shown in FIG. 1, or may be provided on an external surface of the lower plate 102*b* at predetermined positions corresponding to the opposite ends of the channel 103*b* by attaching an electrode material to the external surface, thus providing an EEFL as shown in FIG. 2. However, the electrodes 104*a* provided at opposite ends of the channel 103*a* of the IEFL are problematic in that it is difficult to insert the electrodes 104*a* into and fix them in the ends of the channel 103*a* during an FFL manufacturing process. In an effort to overcome the above-mentioned problems caused in conventional IEFLs, and to avoid direct interaction between the electrodes and the plasma in the serpentine channel, and, furthermore, to accomplish the requirements of providing a large FFL system by integrating a plurality of FFLs into a single system through a tiling method, the EEFLs as illustrated in FIG. 2 have been actively studied and developed.

However, although the above-mentioned serpentine channel defining the long plasma discharge space of an FFL with electrodes provided at opposite ends of the channel provides of the FFL with high optical power and high optical efficiency, the long plasma discharge space undesirably causes a problem in that the plasma discharge start voltage and the plasma discharge drive voltage are undesirably increased. This increases the electric power consumption of the FFL due to the intrinsic properties of the FFL having low optical efficiency relative to the high voltage applied to the electrodes, and reduces both the expected life span and the operational reliability of the FFL, and retards the commencement of operation of the FFL.

Generally, in an FFL, the plasma discharge efficiency and the drive voltage relative to a distance between plasma discharge electrodes vary in inverse proportion to each other. Thus, a reduction in the drive voltage for the FFL may be accomplished by reducing the distance between the electrodes. However, the reduction in the interelectrode distance in the FFL undesirably degrades the plasma discharge efficiency and reduces the size of the FFL.

SUMMARY OF THE INVENTION

Accordingly, the present invention has been made keeping in mind the above problems occurring in the related art, and an object of the present invention is to provide a flat fluorescent lamp (FFL) for display devices, which has an improved plasma discharge electrode structure configured to provide an operational effect expected from a reduction in the distance between electrodes provided at opposite ends of plasma discharge channels although the real distance between the electrodes is not reduced, and which is efficiently operated using a low voltage and has an optical efficiency and a plasma discharge efficiency higher than predetermined levels.

Another object of the present invention is to provide a flat fluorescent lamp (FFL) for display devices, which has various electrode structures able to efficiently generate interelectrode plasma discharge.

In order to achieve the above objects, according to an embodiment of the present invention, there is provided a flat fluorescent lamp (FFL) for display devices, comprising a plurality of branch electrodes extending from main electrodes, provided on opposite ends of a lamp body, in opposite directions toward the opposite main electrodes and being parallel to longitudinal axes of the discharge channels.

The branch electrodes may extend along the boundaries of the discharge channels to prevent a reduction of light efficiency of the FFL that may be caused by such branch electrodes arranged in front of the main electrodes. The boundaries are defined as portions that isolate the discharge channels from each other.

Alternatively, the branch electrodes may extend from the main electrodes along the central axes of the discharge channels. In the above state, the branch electrodes extending along the central axes of the discharge channels are thinner than the branch electrodes extending along the boundaries of the discharge channels, thus minimizing the ill effect of dark areas formed on the FFL due to the branch electrodes.

Furthermore, to allow the branch electrodes to more efficiently emit electric charges, each of the branch electrodes may have a sharp tip. Furthermore, to improve brightness at the outside parts of the FFL, the branch electrodes may be configured such that the outermost branch electrodes located on the outside parts of the lamp body are longer than the central branch electrodes located between the outermost branch electrodes.

The FFL of the present invention may further comprise: a plurality of joint electrodes being arranged parallel to each of the main electrodes and coupling the branch electrodes (particularly, the branch electrodes arranged along the boundaries of the channels) to each other. Furthermore, a plurality of step electrodes may protrude from front joint electrodes toward opposite front joint electrodes, in which the front joint electrodes couple the terminal ends of the branch electrodes to each other.

The joint electrodes allow a voltage applied from an external power source to be more efficiently transmitted into the discharge channels, so that the joint electrodes arranged across the discharge channels (in directions perpendicular to the longitudinal axes of the discharge channels). Thus, the joint electrodes are thinner than the branch electrodes extending along the boundaries of the discharge channels. The step electrodes allow electric charges to be emitted more efficiently, thus improving optical efficiency of the FFL.

Due to the above-mentioned electrode structure, comprising main electrodes and various subsidiary electrodes which are the branch electrodes, the joint electrodes and the step electrodes electrically coupled to the main electrodes, the FFL provides an operational effect expected from a reduction in the distance between the main electrodes provided at opposite ends of the plasma discharge channels although the real distance between the main electrodes is not reduced. Thus, the FFL reduces its start voltage and drive voltage, and more efficiently generates plasma discharge therein. Particularly, as both the branch electrodes and the joint electrodes are arranged such that they form a lattice-shaped electrode structure in front of each of the main electrodes, the FFL is free from a problem of degradation of optical efficiency or discharge efficiency despite the reduction in the interelectrode distance.

When the branch electrodes and the step electrodes are arranged along the boundaries of the discharge channels, which isolate the discharge channels from each other, the locations of the electrodes may be freely designed. In other words, the electrodes may be freely located on the upper surface or lower surface of an FFL upper plate, the upper surface or lower surface of an FFL lower plate, or a joined region between the FFL upper and lower plates.

Furthermore, the branch electrodes may extend from the main electrodes toward the opposite main electrodes such that two branch electrodes extend in opposite directions and are spaced apart from each other in a transverse direction within each of the discharge channels. In the above state, an electric field is induced in each discharge channel in the transverse direction perpendicular to the longitudinal axis of the channel, so that high brightness can be maintained constantly over the whole area of the FFL without any variation in brightness between zones.

The FFL of the present invention may further comprise a plurality of inductive electrodes provided on the lamp body such that the inductive electrodes are arranged along the longitudinal axes of the discharge channels. The inductive electrodes are not supplied with external electricity. Due to the inductive electrodes, a smooth flow of an electric charge is induced in the channels, thus improving the discharge efficiency of the FFL.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
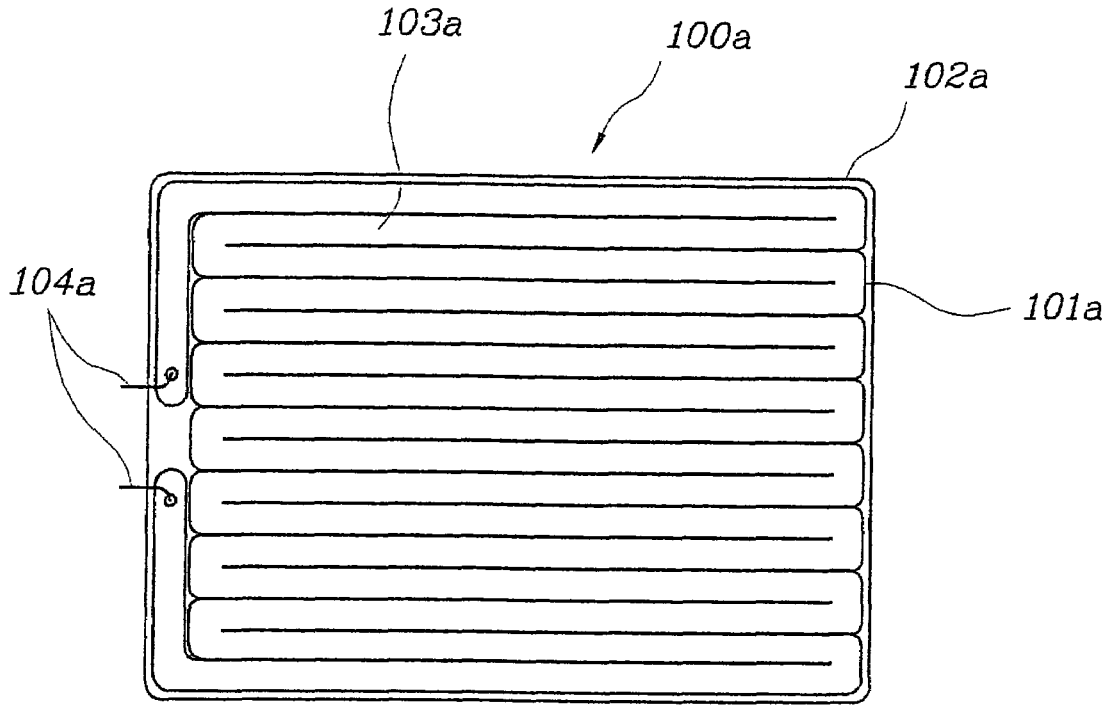
Fig. 1 RELATED ART
FIG. 1 is a plan view illustrating the construction of a conventional internal electrode fluorescent lamp (IEFL) having internal electrodes.
Figure 2:
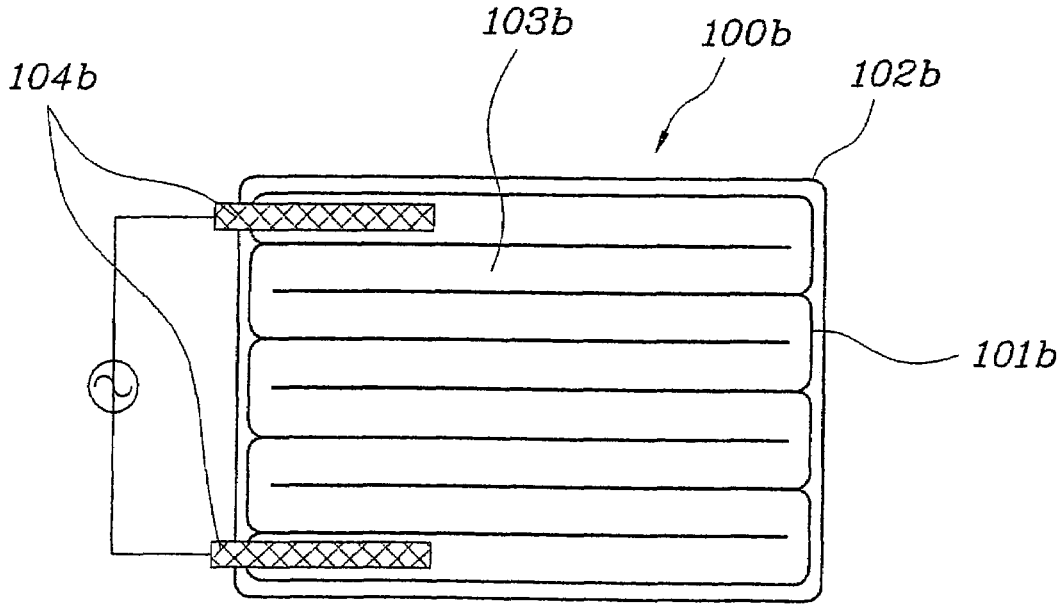
Fig. 2 RELATED ART
FIG. 2 is a plan view illustrating the construction of a conventional external electrode fluorescent lamp (EEFL) having external electrodes.

Reference will now be made in greater detail to preferred embodiments of the invention, examples of which are illustrated in the accompanying drawings. Wherever possible, the same reference numerals will be used throughout the drawings and the description to refer to the same or like parts.

A flat fluorescent lamp (FFL) according to the present invention comprises a lamp body fabricated with an FFL upper plate and an FFL lower plate, a plurality of plasma discharge channels to define isolated plasma discharge spaces in the lamp body, and a plurality of electrodes provided on the lamp body to generate plasma discharge. In the FFL of the present invention, the electrodes may be coated onto or attached to an external surface of the lamp body, for example, an upper surface of the FFL upper body or a lower surface of the FFL lower plate. Alternatively, the electrodes may be coated onto or attached to an internal surface of the lamp body, for example, a lower surface of the FFL upper body or an upper surface of the FFL lower plate. Furthermore, when the electrodes are provided on the FFL upper plate, the electrodes are preferably transparent or preferably have thin shapes so as not to significantly intercept light emitted from the discharge channels, thus minimizing the ill effect of dark areas formed on the FFL due to the electrodes. Of course, various functional layers, such as a dielectric layer and an insulating layer, may be formed on an external surface of each electrode. However, the construction of the above-mentioned functional layers as well as inert gases and mercury vapor injected into the plasma discharge channel, and the construction of a fluorescent layer, a reflecting layer, etc. are well-known to those skilled in the art, and further explanation is thus deemed unnecessary.

Figure 3:
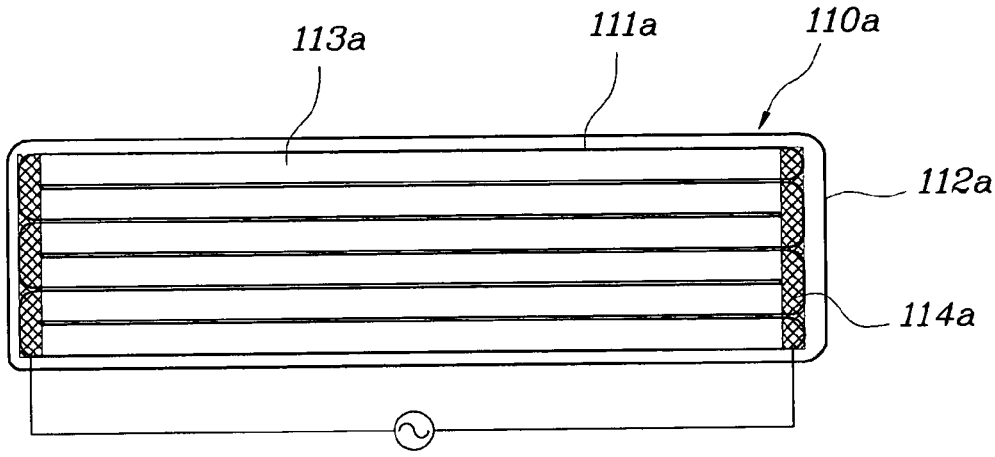
FIG. 3 is a plan view illustrating the construction of a flat electrode fluorescent lamp (FFL) having a first embodiment of main electrodes according to the present invention.
Figure 4:
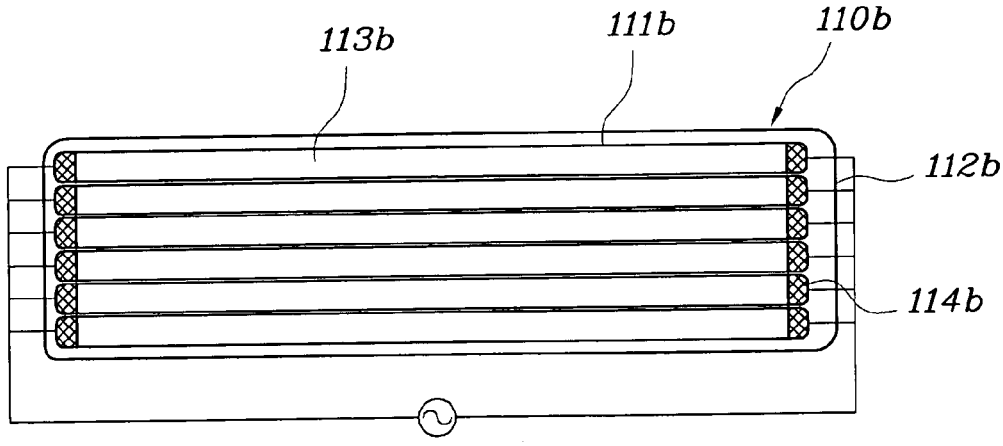
FIG. 4 is a plan view illustrating the construction of an FFL having a second embodiment of main electrodes according to the present invention.
Figure 17:
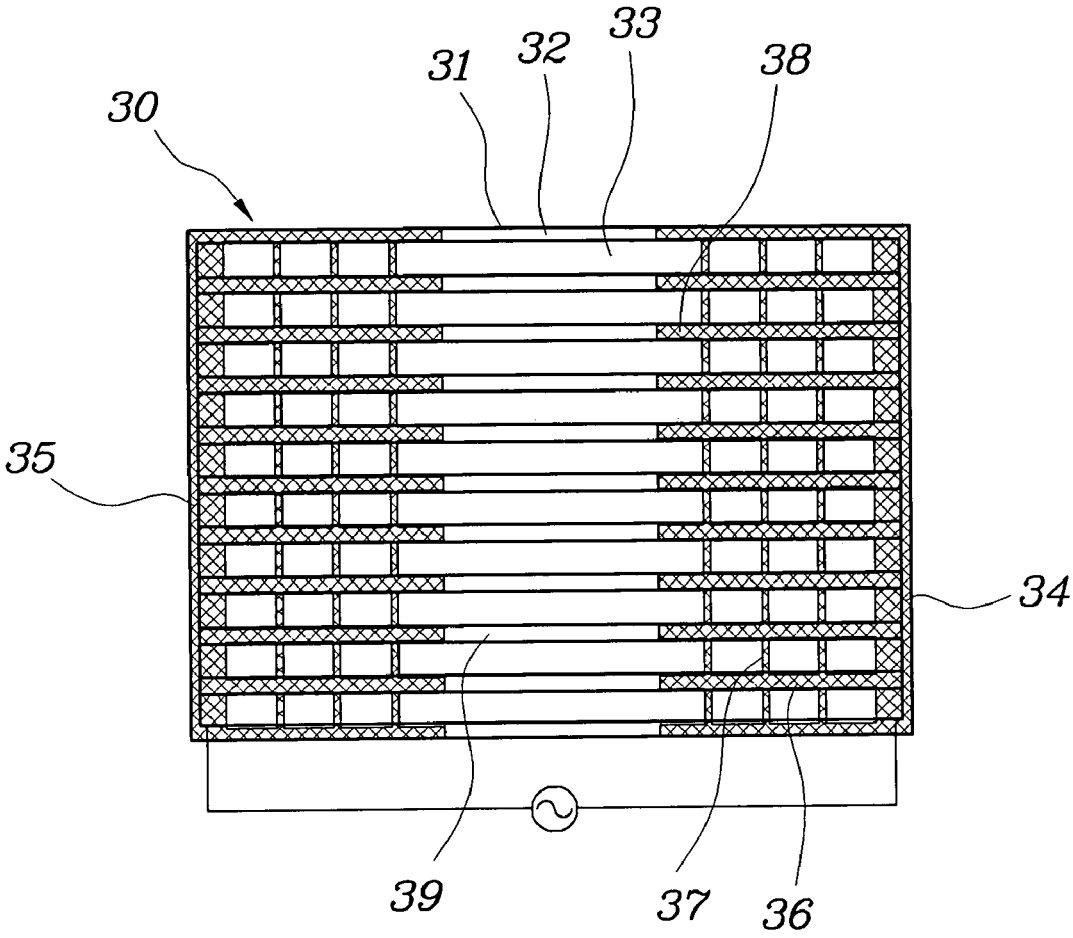
FIG. 17 is a plan view illustrating the construction of an FFL having linear channels partitioned and isolated from each other by partition walls, including electrodes according to the present invention used in the FFL.

The plasma discharge channel according to the present invention may be configured such that several linear discharge channels 113*a* are connected together to form a continuous long channel having a serpentine shape and defining therein a single discharge path as shown in FIG. 3. Alternatively, the plasma discharge channel may be configured such that several linear discharge channels 113*b* are arranged to form therein individual sealed discharge paths isolated from each other as shown in FIG. 4. The plasma discharge channels 113*a*, 113*b* may be formed by integrating a channeled upper plate 111*a*, 111*b* and a flat lower plate 112*a*, 112*b* along their edges into a single lamp body 110*a*, 110*b* as shown in FIGS. 3 and 4, or may be formed by providing partition walls 37 between an upper plate 31 and a lower plate 32 which are integrated along their edges into a single body using a sealing member as shown in FIG. 17. The sealing member can function as a sidewall of the lamp body. Furthermore, the partition walls 37 may be integrated with the upper plate or the lower plate of the FFL.

As illustrated in FIGS. 3 and 4, the FFL according to the present invention is provided with main electrodes 114*a*, 114*b* formed on the lower surface of the lower plate 112*a*, 112*b* at predetermined positions corresponding to opposite ends of the discharge channels 113*a*, 113*b* such that the main electrodes 114*a*, 114*b* are perpendicular to the longitudinal axes of the channels 113*a*, 113*b*.

The main electrodes 114*a*, 114*b* provided at predetermined positions corresponding to the opposite ends of the discharge channels may be continuously formed at each side of the FFL along the ends of the discharge channels 113*a*, 113*b* as shown in FIG. 3, or may be discontinuously formed at each side of the FFL such that the main electrodes 114*a*, 114*b* are formed only at positions corresponding to the ends of the discharge channels as shown in FIG. 4. When an AC voltage is applied to the main electrodes 114*a*, 114*b*, plasma discharge occurs along the discharge channels 113*a*, 113*b*.

Figure 5:
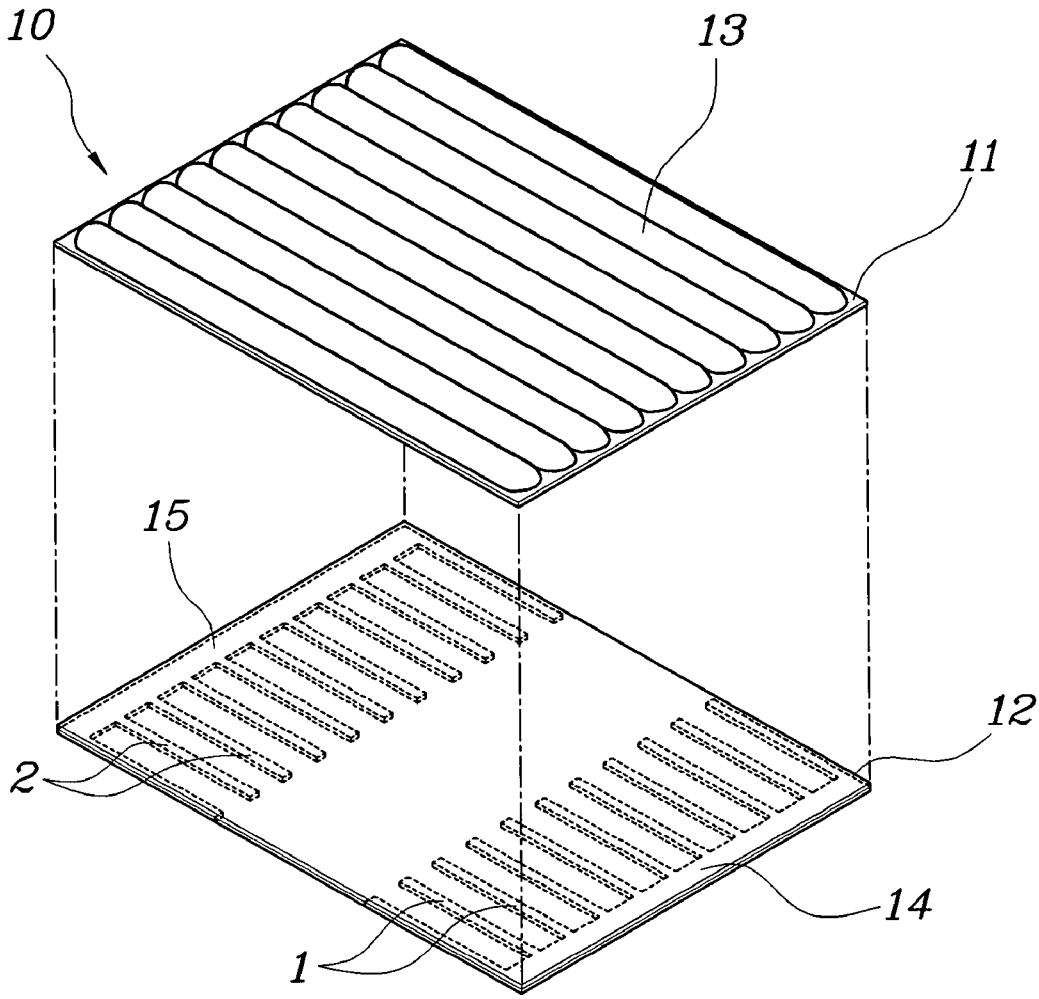
FIG. 5 is an exploded perspective view illustrating the construction of an FFL having a first embodiment of branch electrodes according to the present invention.
Figure 6:
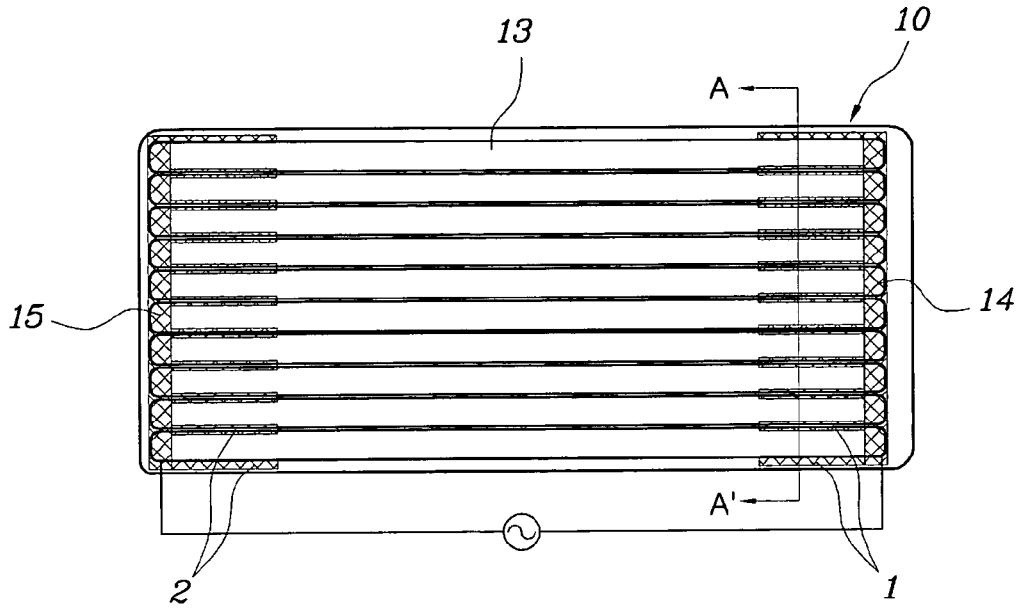
FIG. 6 is a plan view illustrating the FFL of FIG. 5 after parts of the FFL have been integrated into a single structure.
Figure 7:
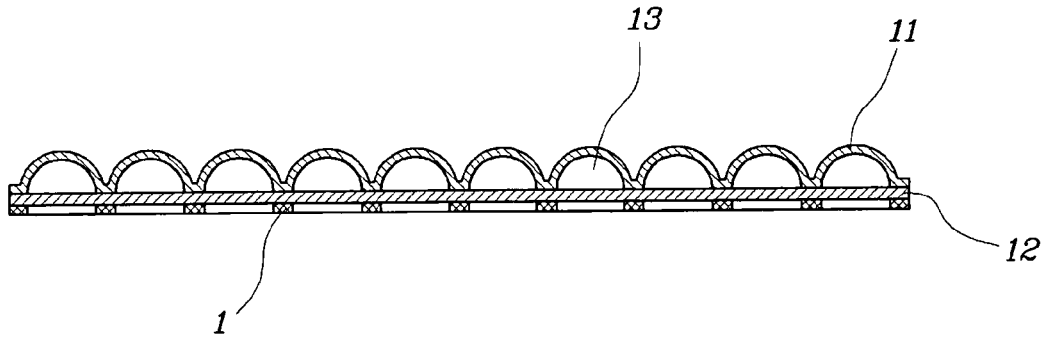
FIG. 7 is a sectional view taken along the line A-A' of FIG. 6.

In the present invention, a plurality of branch electrodes is formed on a lamp body 10 of an FFL in addition to the main electrodes such that the branch electrodes having predetermined lengths extend from the main electrodes 14 and 15, provided at opposite ends of the lamp body 10, in opposite directions toward the opposite main electrodes 15, 14 and are parallel to the longitudinal axes of linear discharge channels 13, as shown in FIGS. 5, 6 and 7.

As shown in FIGS. 5 through 7, the branch electrodes 1 and 2 according to a first embodiment of the present invention extend from the main electrodes 14 and 15 a predetermined identical length of about ⅓ of the length of each discharge channel 13. The branch electrodes 1 and 2 may be provided on the lower surface of a lower plate 12 along predetermined lines corresponding to the boundaries of the channels 13 defined by both the junction lines between the channels 13 and the outside edges of the two outermost channels 13 which are the outside edges of the lamp body. The above-mentioned boundaries of the channels 13 are included in non-discharge zones where plasma discharge does not occur. A fluorescent material may be coated on the external surfaces of the boundaries of the channels 13.

Due to the branch electrodes 1 and 2 extending from the main electrodes 14 and 15 toward the opposite main electrodes 15 and 14, an effect expected from a reduction in the distance between the main electrodes 14 and 15 can be achieved although the real distance between the main electrodes 14 and 15 is not reduced. Thus, to generate plasma discharge to provide the same brightness, the FFL of this invention having branch electrodes as well as main electrodes can be operated using a voltage lower than that required by an FFL having only main electrodes. Furthermore, the branch electrodes 1 and 2 are arranged along non-discharge zones of the FFL, so that the branch electrodes 1 and 2 do not cause a reduction in brightness around the plasma discharge electrodes of the FFL due to an electric charge accumulated around the electrodes during plasma discharge. In addition, even when the branch electrodes are provided on an upper plate 11 of the FFL, the branch electrodes do not significantly intercept light emitted from the discharge channels 13 because the branch electrodes are provided along the boundaries of the channels 13.

The branch electrodes of the present invention may be variously altered as shown in FIGS. 8 through 11.

Figure 8:
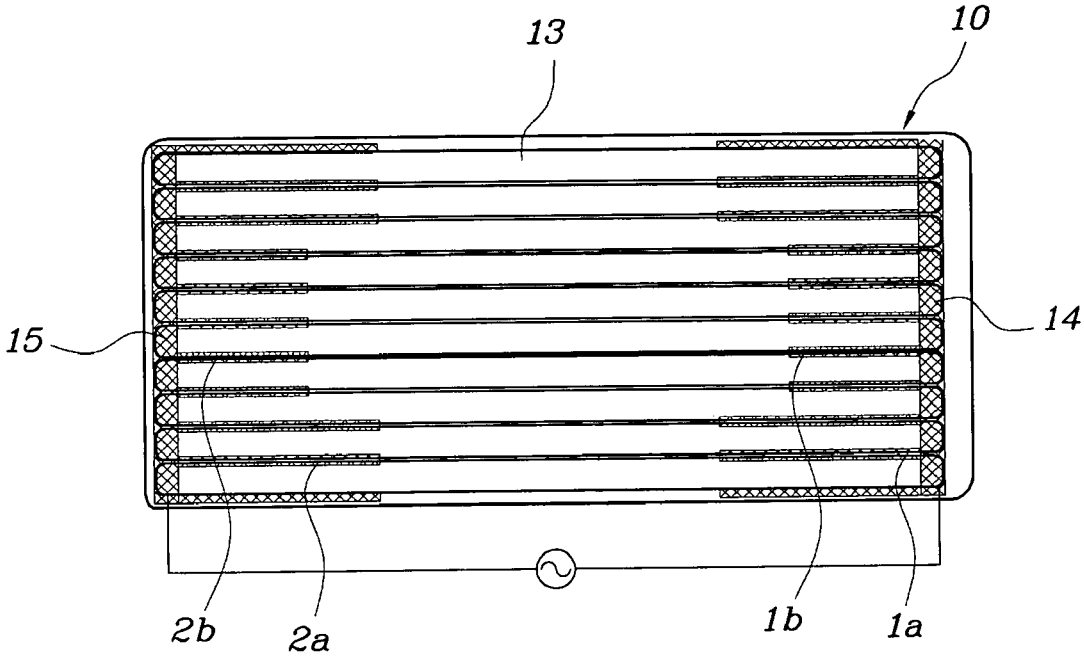
FIG. 8 is a plan view illustrating the construction of an FFL having a second embodiment of branch electrodes according to the present invention.

As illustrated in FIG. 8 showing an FFL having a second embodiment of branch electrodes according to the present invention, the branch electrodes may be configured such that the length of the outermost branch electrodes 1*a* and 2*a* is longer than that of central branch electrodes 1*b* and 2*b* located between the outermost branch electrodes 1*a* and 2*a*. The general shape of the FFL having the branch electrodes according to the second embodiment remains the same as that described for the FFL having the branch electrodes according to the first embodiment, except for the difference in the length of the branch electrodes. Thus, brightness around the outside edge of the FFL having the outermost discharge channels 13 can be increased. Therefore, when providing a large FFL system by integrating a plurality of FFLs into a single system through a tiling method, brightness of the junctions between the FFLs is not reduced.

Figure 9:
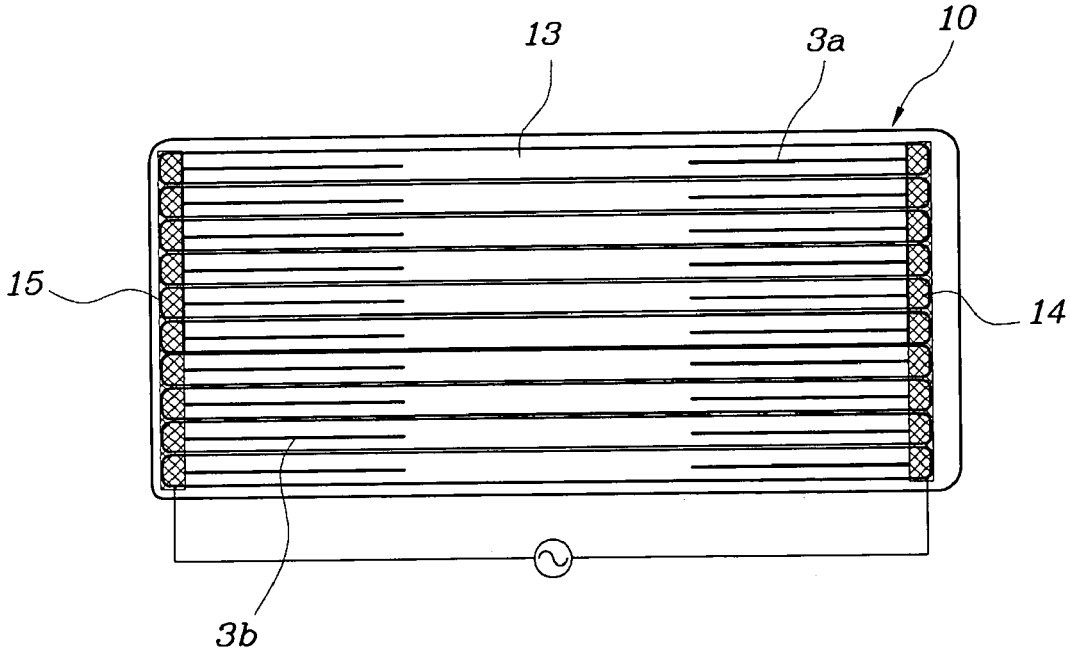
FIG. 9 is a plan view illustrating the construction of an FFL having a third embodiment of branch electrodes according to the present invention.

As illustrated in FIG. 9 showing an FFL having a third embodiment of branch electrodes according to the present invention, the branch electrodes 3*a* and 3*b* may be provided on the lower surface of a lower plate 12 along lines corresponding to longitudinal axes of the discharge channels 13. In this embodiment, the width of the branch electrodes 3*a* and 3*b* must be narrower than the first and second embodiments of the branch electrodes, so that, even when the branch electrodes are provided on the upper plate of the FFL, the branch electrodes do not significantly intercept light emitted from the discharge channels 13. Thus, the ill effect of dark areas formed on the FFL due to the branch electrodes can be minimized.

Figure 10:
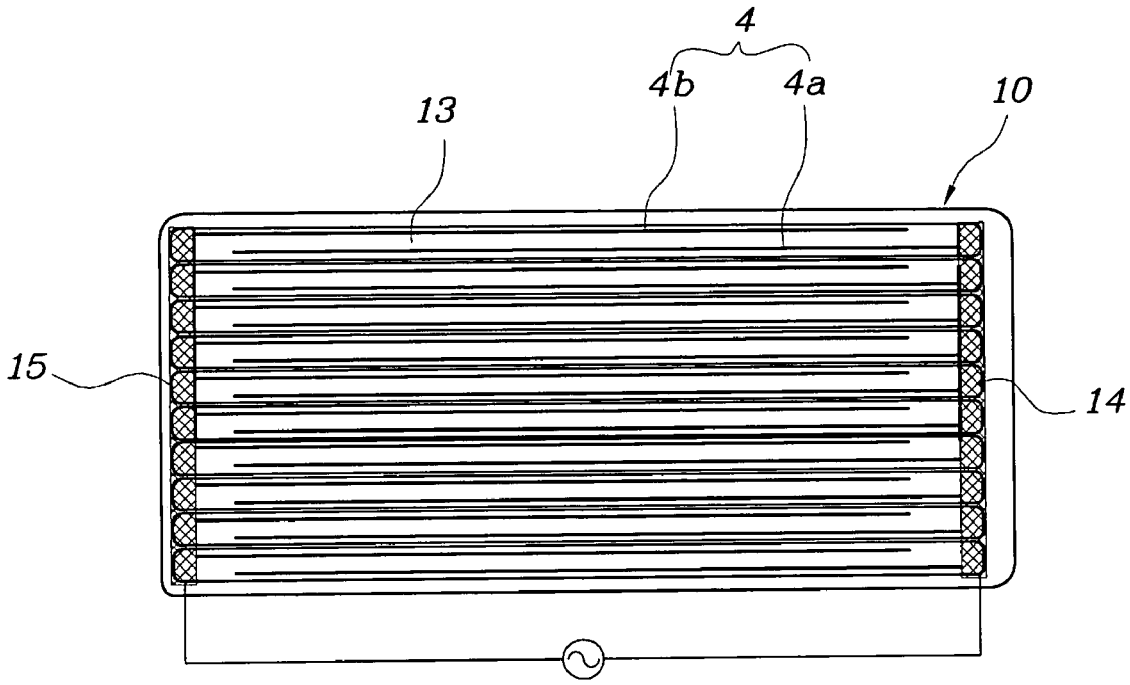
FIG. 10 is a plan view illustrating the construction of an FFL having a fourth embodiment of branch electrodes according to the present invention.

As illustrated in FIG. 10 showing an FFL having a fourth embodiment of branch electrodes according to the present invention, a pair of branch electrodes 4*a* and 4*b* may be provided on the lower surface of a lower plate 12 along lines within a region corresponding to each discharge channel 13. The pair of narrow branch electrodes 4*a* and 4*b* longitudinally and parallely extends from associated main electrodes 14 and 15 in opposite directions to approach opposite main electrodes and spaced apart from each other in a transverse direction of each channel 13. Due to the pairs of branch electrodes 4 each comprising the branch electrodes 4*a* and 4*b*, an electric field is induced in each channel 13 in the transverse direction perpendicular to the longitudinal axis of the channel 13 when an AC voltage is applied to the main electrodes 14 and 15. Thus, the branch electrodes 4*a* and 4*b* reduce the drive voltage for the FFL and improve optical efficiency, and maintain brightness constantly over the whole area of the FFL without any variation in brightness between zones.

Figure 11:
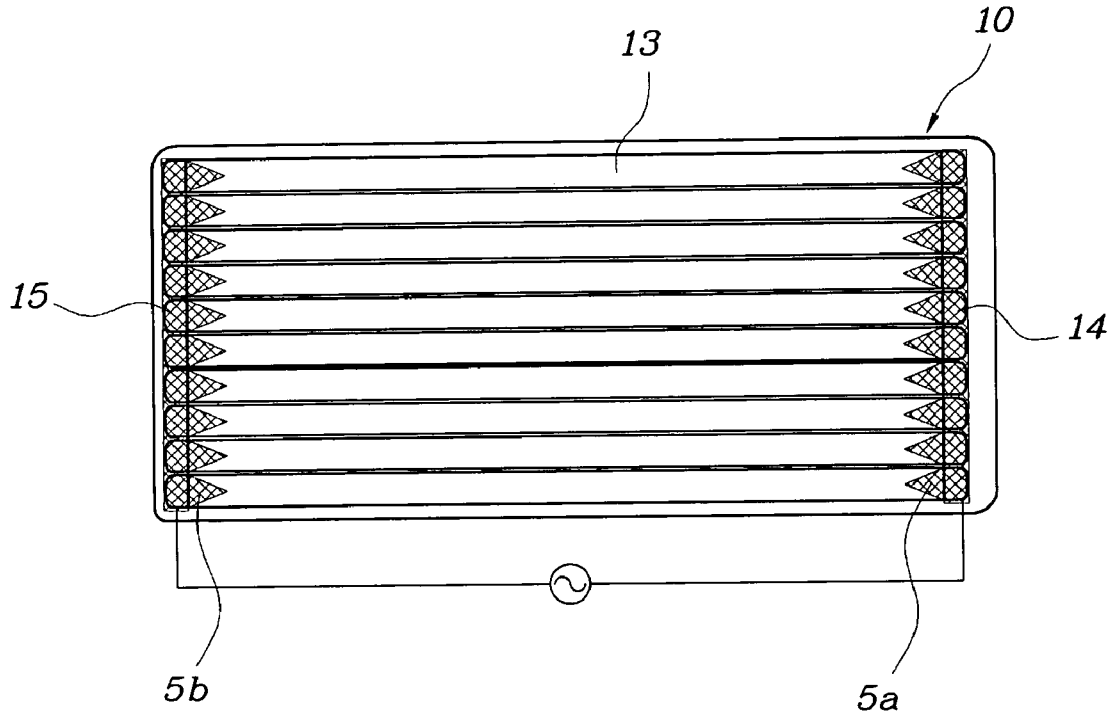
FIG. 11 is a plan view illustrating the construction of an FFL having a fifth embodiment of branch electrodes according to the present invention.

As illustrated in FIG. 11 showing an FFL having a fifth embodiment of branch electrodes according to the present invention, the branch electrodes 5*a* and 5*b* may be provided on the upper surface of a lower plate 12 at positions corresponding to central positions around the ends of the discharge channels 13. In this embodiment, the main electrodes 14 and 15 may be provided on the upper surface of the lower plate 12 to agree with the branch electrodes provided on the upper surface of the lower plate. The branch electrodes 5*a* and 5*b* having short lengths and sharp tips protrude from the main electrodes 14 and 15 in opposite directions towards the opposite main electrodes 15 and 14. The above-mentioned branch electrodes 5*a* and 5*b* more efficiently emit electric charges.

In the present invention, the FFL may be provided with both joint electrodes and step electrodes which are electrically coupled to the branch electrodes, as shown in FIGS. 12 through 15.

Figure 12:
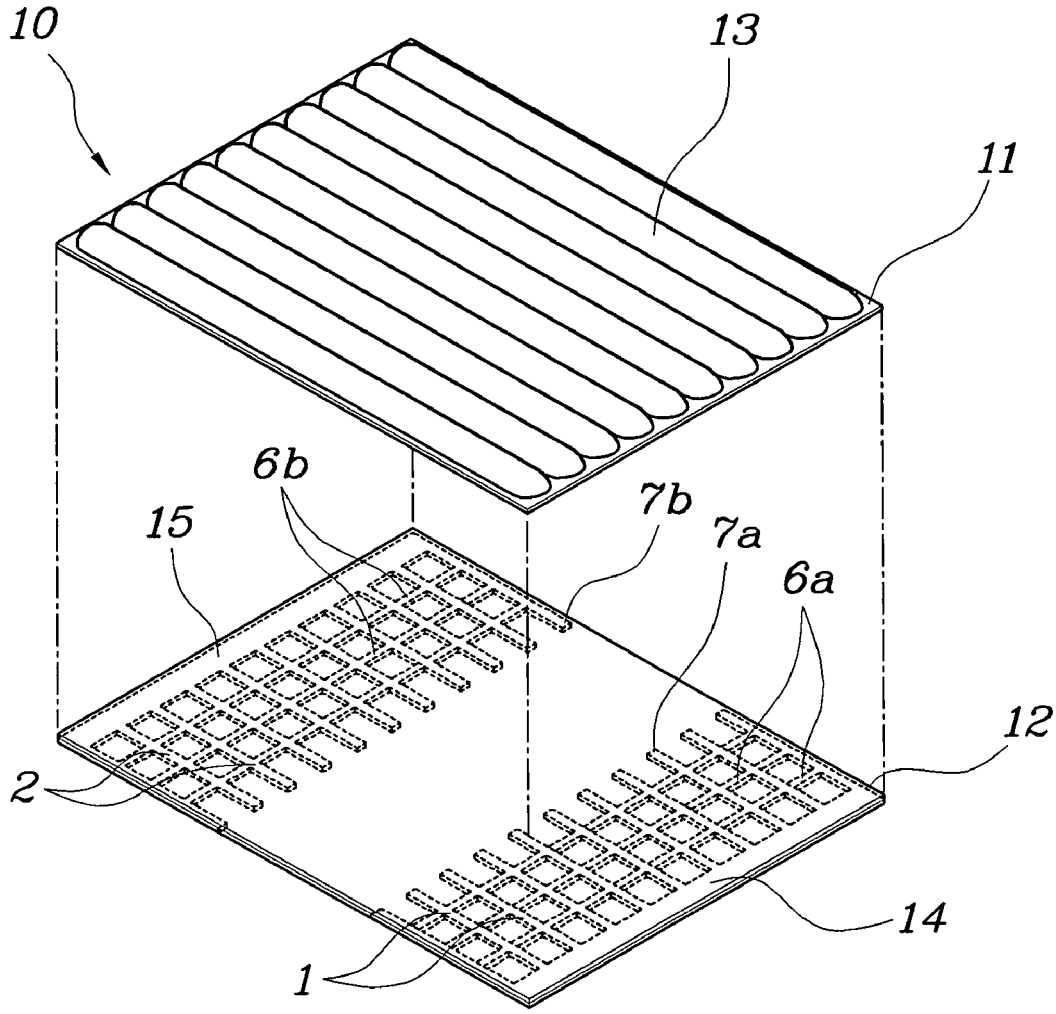
FIG. 12 is an exploded perspective view illustrating the construction of an FFL having a first embodiment of joint electrodes and step electrodes according to the present invention.
Figure 13:
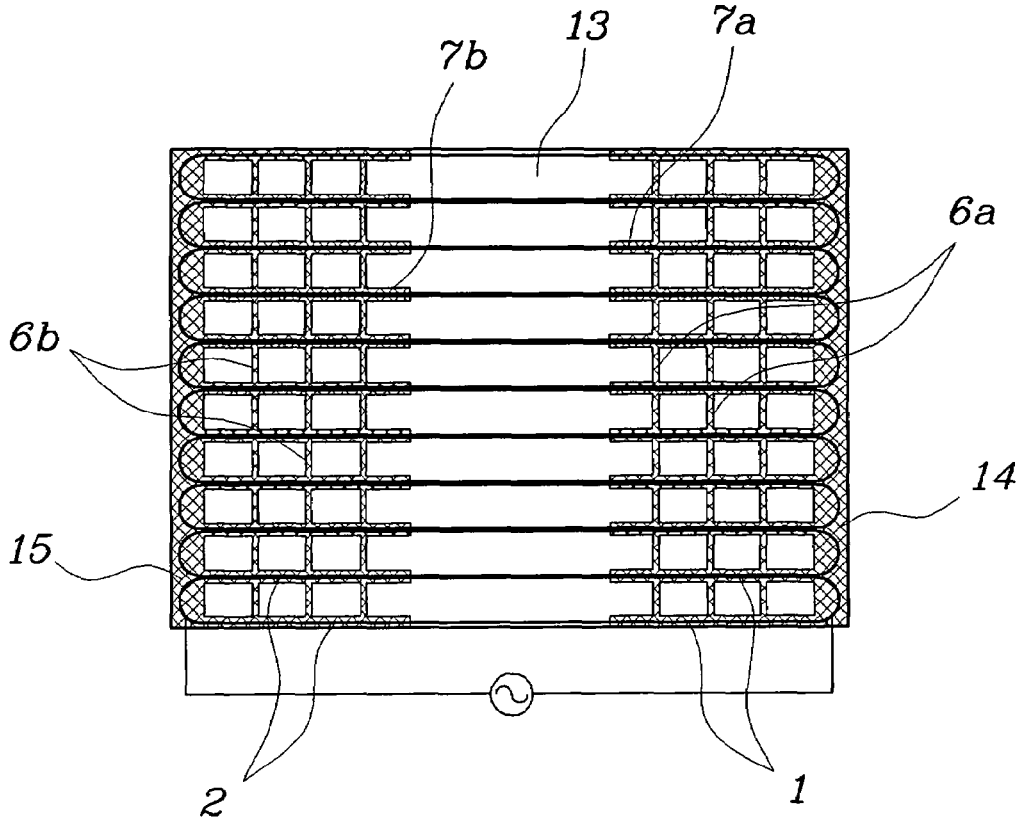
FIG. 13 is a plan view illustrating the FFL of FIG. 12 after parts of the FFL have been integrated into a single structure.

As illustrated in FIGS. 12 and 13, the joint electrodes 6*a* and 6*b* are arranged parallel to the main electrodes 14 and 15 such that the joint electrodes 6*a* and 6*b* electrically couple the branch electrodes 1, 2 to each other. Due to the joint electrodes 6*a* and 6*b* and the branch electrodes 1 and 2, a lattice-shaped electrode structure is provided in front of each of the main electrodes 14 and 15. When a discharge voltage is applied to the upper surface of the lower plate 12 having the lattice-shaped electrode structure, plasma discharge occurs more efficiently in the FFL.

The joint electrodes 6*a* and 6*b* include front joint electrodes to couple the terminal ends of the branch electrodes 1 and 2 to each other. The step electrodes of the present invention protrude from the front joint electrodes toward opposite front joint electrodes along the longitudinal axes of the channels 13.

As illustrated in FIGS. 12 and 13 showing an FFL having a first embodiment of joint electrodes and step electrodes according to the present invention, the step electrodes 7*a* and 7*b* may be provided on the lower surface of the lower plate 12 along predetermined lines corresponding to the boundaries of the channels 13 defined by the junction lines between the channels 13 and the outside edges of the outermost channels 13.

Figure 14:
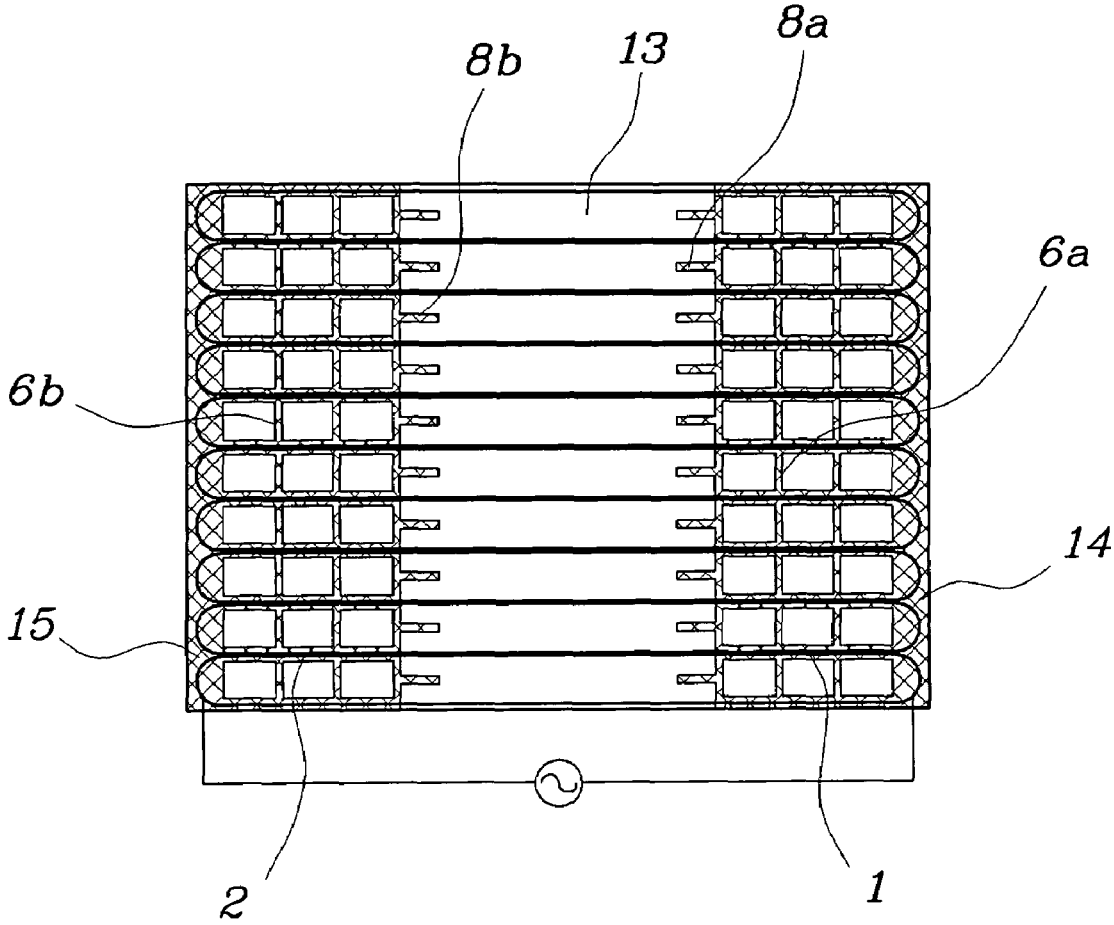
FIG. 14 is a plan view illustrating the construction of an FFL having a second embodiment of step electrodes according to the present invention.

As illustrated in FIG. 14 showing an FFL having a second embodiment of step electrodes according to the present invention, the step electrodes 8*a* and 8*b* may be provided on the lower surface of the lower plate along predetermined lines corresponding to the longitudinal axes of the channels 13.

Figure 15:
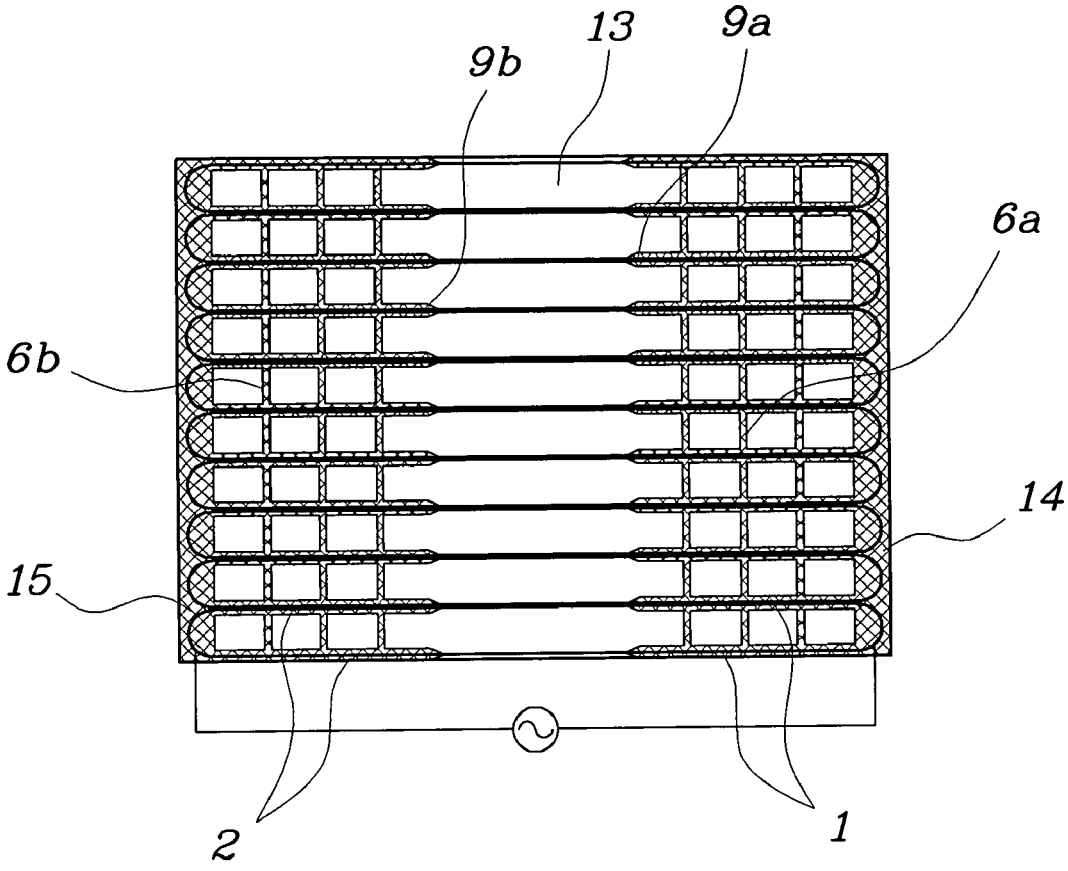
FIG. 15 is a plan view illustrating the construction of an FFL having a third embodiment of step electrodes according to the present invention.

As illustrated in FIG. 15 showing an FFL having a third embodiment of step electrodes according to the present invention, the step electrodes 9*a* and 9*b*, which are located in the same place as that described for the second embodiment of the step electrodes, may be sharpened at their terminal ends.

The above-mentioned step electrodes more efficiently emit electric charges, thus reducing both the discharge voltage and the drive voltage for the FFL and improving the optical efficiency of the FFL.

Figure 16:
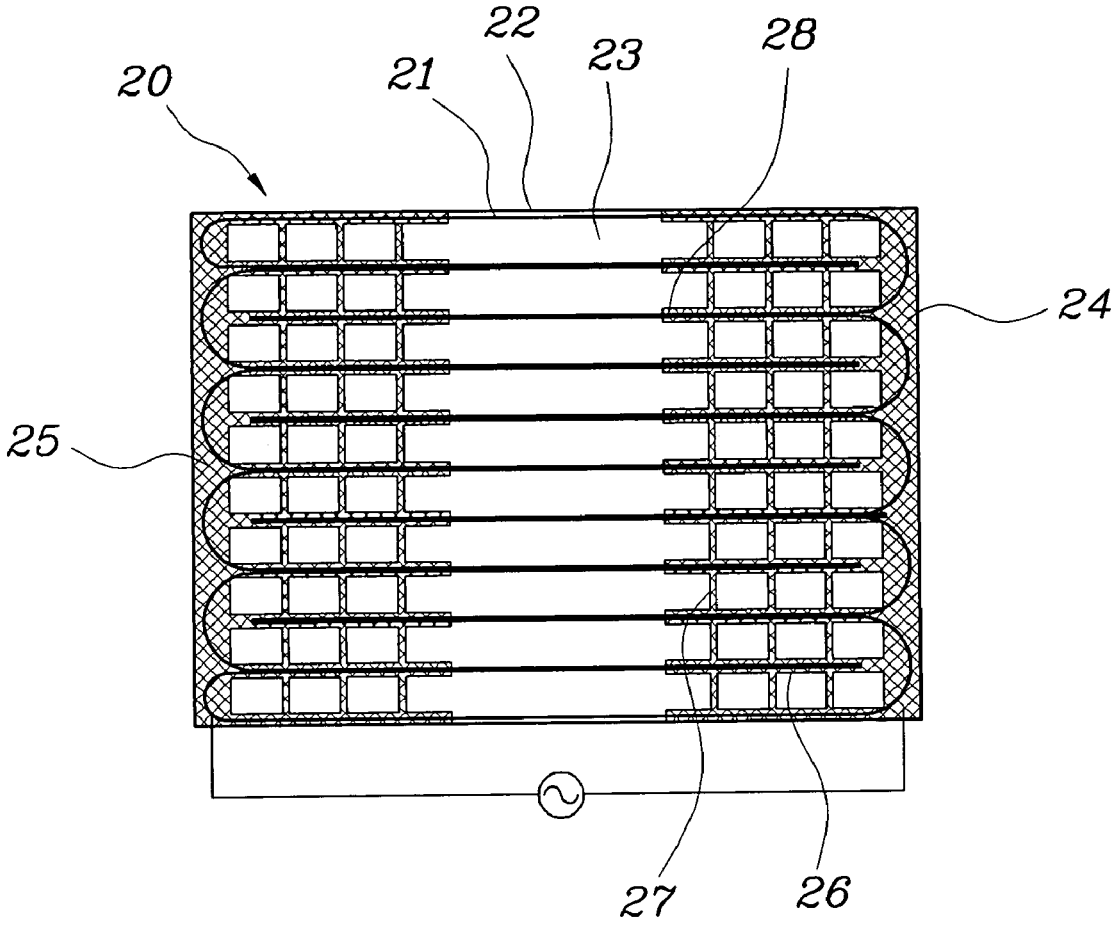
FIG. 16 is a plan view illustrating the construction of an FFL having a serpentine channel, including electrodes according to the present invention used in the FFL.

The above-mentioned electrode structure according to the present invention, comprising main electrodes, branch electrodes, joint electrodes and step electrodes, may be used in an FFL having a serpentine channel 23 as illustrated in FIG. 16, or may be used in an FFL having linear discharge channels 33 partitioned and isolated from each other by partition walls 39 as illustrated in FIG. 17. In FIGS. 16 and 17, the reference numerals 20 and 30 denote a lamp body of the FFL; 21 and 31 denote an upper plate of the FFL; 22 and 32 denote a lower plate of the FFL; 24, 25, 34 and 35 denote a main electrode; 26 and 36 denote a branch electrode; 27 and 37 denote a joint electrode; and 28 and 38 denote a step electrode.

Figure 18:
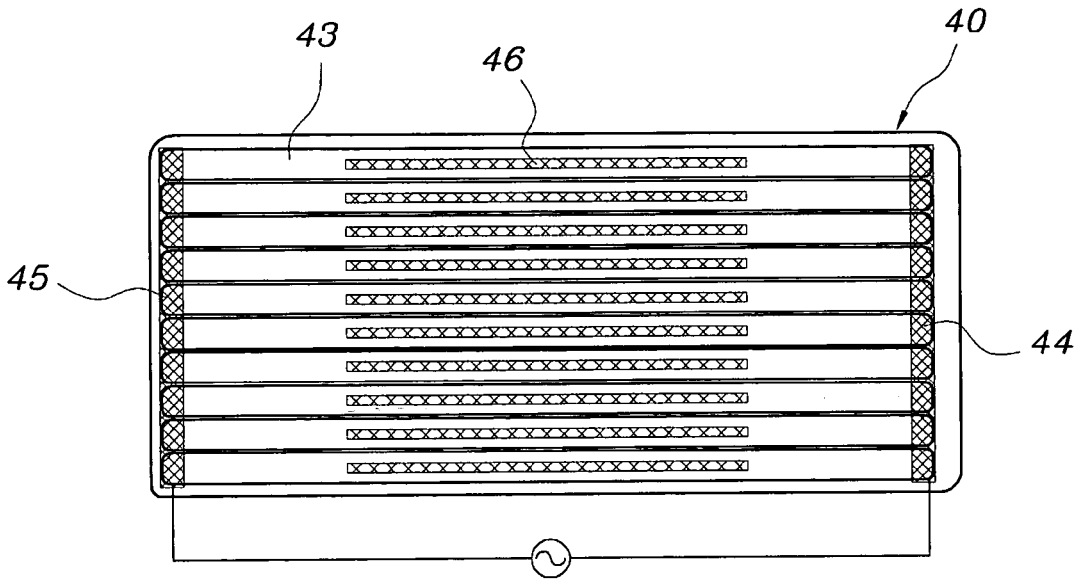
FIG. 18 is a plan view illustrating the construction of an FFL having a first embodiment of inductive electrodes according to the present invention.
Figure 19:
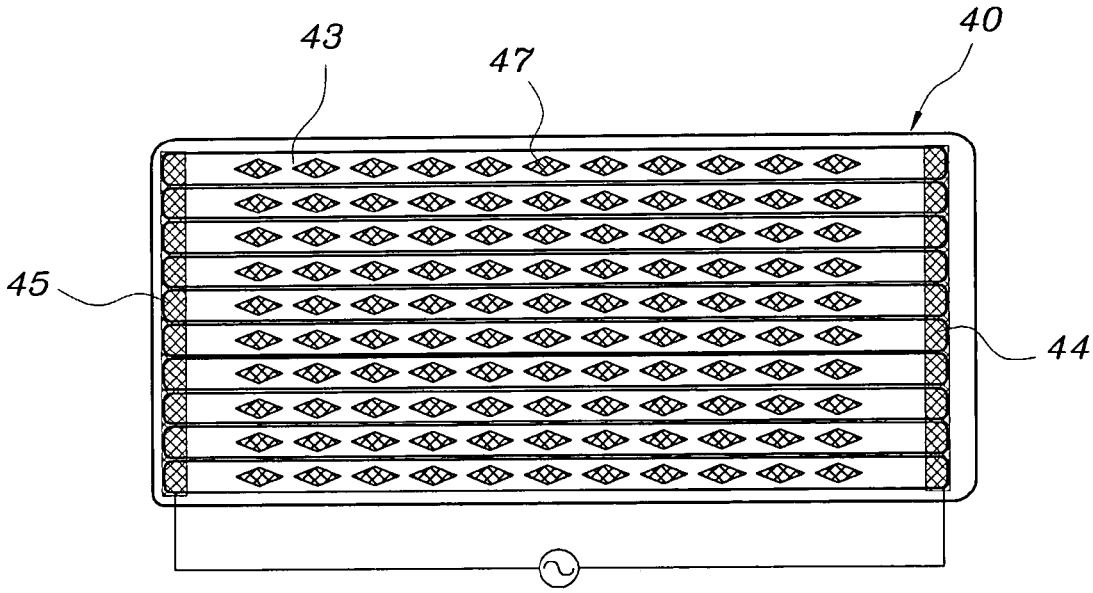
FIG. 19 is a plan view illustrating the construction of an FFL having a second embodiment of inductive electrodes according to the present invention.

As illustrated in FIGS. 18 and 19, inductive electrodes 46, 47 may be longitudinally provided on the upper surface of a lower plate of a lamp body 40 along lines corresponding to the longitudinal axes of discharge channels 43. The inductive electrodes 46, 47 are not connected to an external power source, thus not being supplied with external electricity. Furthermore, the inductive electrodes 46, 47 are not coupled to main electrodes 44 and 45, unlike the above-mentioned branch electrodes and step electrodes.

In a detailed description, as illustrated in FIG. 18 showing an FFL having a first embodiment of inductive electrodes according to the present invention, the inductive electrodes may comprise continuous strip-shaped inductive electrodes 46 that are longitudinally formed along lines corresponding to central portions of the discharge channels 43. The inductive electrodes 46 induce a flow of an electric charge in the channels 43 between the main electrodes 44 and 45, thus reducing both the discharge voltage and the drive voltage for the FFL, and maintaining brightness constantly over the whole area of the FFL without any variation in brightness between zones.

As illustrated in FIG. 19 showing an FFL having a second embodiment of inductive electrodes according to the present invention, the inductive electrodes may comprise subsidiary inductive electrodes 47 which have sharp tips in the longitudinal directions of the discharge channels 43 and are intermittently arrayed along lines corresponding to the longitudinal axes of the discharge channels 43 and spaced apart from each other at regular intervals. Due to the subsidiary inductive electrodes 47, the flow of an electric charge in the channels 43 between the main electrodes 44 and 45 can be more efficiently induced.

As apparent from the above description, the present invention provides a flat fluorescent lamp (FFL) for display devices, which has an improved electrode structure comprising branch electrodes, joint electrodes and step electrodes that are electrically coupled to main electrodes. Thus, the FFL of the present invention provides an operational effect expected from a reduction in the distance between the main electrodes provided at opposite ends of plasma discharge channels although the real distance between the main electrodes is not reduced. Thus, the start voltage and the drive voltage of the FFL are reduced. Furthermore, due to the improved electrode structure, plasma discharge more efficiently occurs in the FFL, thus improving optical efficiency of the FFL and maintaining brightness constantly over the whole area of the FFL without any variation in brightness between zones.

Furthermore, inductive electrodes may be provided between the main electrodes, thus inducing a smooth flow of an electric charge in the channels, thereby further improving the optical efficiency of the FFL.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A flat fluorescent lamp for display devices, comprising:

a lamp body fabricated with an upper plate and a lower plate which are integrated into a single body, a plurality of discharge channels defining isolated discharge spaces in the lamp body;

a plurality of main electrodes provided on the lamp body at predetermined positions corresponding to opposite ends of the discharge channels; and a plurality of branch electrodes extending from the main electrodes in opposite directions toward the opposite main electrodes, wherein the branch electrodes are parallel to longitudinal axes of the discharge channels and extend along boundaries of the discharge channels, the boundaries isolating the discharge channels from each other, and wherein the branch electrodes are configured such that outermost branch electrodes located on outside parts of the lamp body are longer than central branch electrodes located between the outermost branch electrodes.

2. The flat fluorescent lamp for display devices according to claim 1, wherein the main electrodes are arranged perpendicular to the longitudinal axes of the discharge channels and are continuous along longitudinal directions thereof.

3. The flat fluorescent lamp for display devices according to claim 1, wherein the main electrodes are arranged perpendicular to the longitudinal axes of the discharge channels and are discontinuous along longitudinal directions thereof.

4. The flat fluorescent lamp for display devices according to claim 1, wherein each of the branch electrodes has a sharp tip.

5. The flat fluorescent lamp for display devices according to claim 1, further comprising a plurality of joint electrodes that couple the branch electrodes.

6. The flat fluorescent lamp for display devices according to claim 5, further comprising:

a plurality of step electrodes protruding from front joint electrodes toward opposite front joint electrodes, the front joint electrodes coupling terminal ends of the branch electrodes.

7. The flat fluorescent lamp for display devices according to claim 6, wherein the step electrodes extend along boundaries of the discharge channels, the boundaries isolating the discharge channels from each other.

8. The flat fluorescent lamp for display devices according to claim 6, wherein the step electrodes extend along central axes of the discharge channels.

9. The flat fluorescent lamp for display devices according to claim 6, wherein each of the step electrodes has a sharp tip.

10. A flat fluorescent lamp for display devices, comprising:

a lamp body fabricated with an upper plate and a lower plate which are integrated into a single body, a plurality of discharge channels defining isolated discharge spaces in the lamp body;

a plurality of main electrodes provided on the lamp body at predetermined positions corresponding to opposite ends of the discharge channels; and a plurality of branch electrodes extending from the main electrodes in opposite directions toward the opposite main electrodes and being parallel to longitudinal axes of the discharge channels, wherein the branch electrodes are configured such that outermost branch electrodes located on outside parts of the lamp body are longer than central branch electrodes located between the outermost branch electrodes.

11. A flat fluorescent lamp for display devices, comprising:

a lamp body fabricated with an upper plate and a lower plate which are integrated into a single body, a plurality of discharge channels defining isolated discharge spaces in the lamp body;

a plurality of main electrodes provided on the lamp body at predetermined positions corresponding to opposite ends of the discharge channels;

a plurality of branch electrodes extending from the main electrodes in opposite directions toward the opposite main electrodes, wherein the branch electrodes are parallel to longitudinal axes of the discharge channels and extend along boundaries of the discharge channels, the boundaries isolating the discharge channels from each other;

a plurality of joint electrodes that couple the branch electrodes;

a plurality of step electrodes protruding from front joint electrodes toward opposite front joint electrodes, the front joint electrodes coupling terminal ends of the branch electrodes, wherein the step electrodes extend along central axes of the discharge channels.

* * * * *